US008162553B2

(12) United States Patent
Vandermeulen

(10) Patent No.: US 8,162,553 B2
(45) Date of Patent: Apr. 24, 2012

(54) CASSETTTE LOCKING AND EJECTING ARRANGEMENT

(75) Inventor: Kris Vandermeulen, Bornem (BE)

(73) Assignee: Dymo, Sint-Niklaas (BE)

( * ) Notice: Subject to any disclaimer, the term of this patent is extended or adjusted under 35 U.S.C. 154(b) by 818 days.

(21) Appl. No.: 11/659,857

(22) PCT Filed: Aug. 8, 2005

(86) PCT No.: PCT/IB2005/002493

§ 371 (c)(1),
(2), (4) Date: May 15, 2007

(87) PCT Pub. No.: WO2006/024913

PCT Pub. Date: Mar. 9, 2006

(65) Prior Publication Data

US 2008/0080922 A1 Apr. 3, 2008

(30) Foreign Application Priority Data

Aug. 10, 2004 (GB) ..... 0417795.2

(51) Int. Cl.
*B41J 15/04* (2006.01)
*B65H 19/12* (2006.01)

(52) U.S. Cl. ..... 400/613; 400/693

(58) Field of Classification Search ..... 400/613, 400/88, 693; 242/347

See application file for complete search history.

(56) References Cited

U.S. PATENT DOCUMENTS 4,492,315 A 1/1985 Hooper
4,494,806 A * 1/1985 Williams et al. ..... 312/333
4,627,037 A * 12/1986 Tamaru et al. ..... 720/633
4,757,400 A 7/1988 Park
4,925,258 A * 5/1990 Ludwig et al. ..... 312/323
5,228,636 A * 7/1993 Tanaka ..... 242/337.1
5,435,657 A * 7/1995 Pearce et al. ..... 400/208

(Continued)

FOREIGN PATENT DOCUMENTS

EP 1 052 105 A1 11/2000

(Continued)

OTHER PUBLICATIONS

International Preliminary Report on Patentability for International Application No. PCT/IB2005/002493, dated Feb. 13, 2007.

(Continued)

*Primary Examiner* — Daniel J Colilla
(74) *Attorney, Agent, or Firm* — Marshall, Gerstein & Borun LLP

(57) ABSTRACT

A label printer comprising a cassette-receiving bay, said cassette-receiving bay having a base, a top opening opposite the base, a locking mechanism, and an ejector mechanism extending from said base, said ejector mechanism having an ejector part having an upper surface for cooperation with a cassette, said ejector part being movable in a first direction towards said base and biased in a second direction towards said top opening such that a force on the ejector part directed towards said base causes the ejector part to move in the first direction and wherein said ejector part is biased to move in said second direction when the force is removed, said ejector mechanism being arranged whereby when a cassette is inserted into the cassette receiving bay, said ejector part extends through an opening in a base of the cassette.

4 Claims, 17 Drawing Sheets

U.S. PATENT DOCUMENTS

| | | | | |
|---|---|---|---|---|
| 5,739,839 | A | 4/1998 | Iwai et al. | |
| 5,806,995 | A | 9/1998 | Tsushima et al. | |
| 5,921,688 | A | 7/1999 | Furuya et al. | |
| 6,038,100 | A | 3/2000 | Nagatsuka et al. | |
| 6,406,202 | B1 | 6/2002 | Unno et al. | |
| 7,173,815 | B2 * | 2/2007 | Lee | 361/679.57 |

FOREIGN PATENT DOCUMENTS

| | | | | |
|---|---|---|---|---|
| JP | 60-145055 | U | | 9/1985 |
| JP | 60-196389 | | | 2/1986 |
| JP | 61029452 | A | * | 2/1986 |
| JP | 61-098416 | U | | 6/1986 |
| JP | 61158492 | A | * | 7/1986 |
| JP | 62-007651 | U | | 1/1987 |
| JP | 62-256675 | | | 11/1987 |
| JP | 4-268272 | A | | 9/1992 |
| JP | 8-090887 | A | | 4/1996 |
| JP | 09-277678 | A | | 10/1997 |
| JP | 11213508 | A | * | 8/1999 |
| JP | 2003-089257 | | | 7/2003 |
| JP | 2003-251902 | | | 12/2003 |
| WO | WO-00/32401 | A1 | | 6/2000 |
| WO | WO-2004/059241 | A2 | | 7/2004 |

OTHER PUBLICATIONS

International Search Report for International Application No. PCT/IB2005/002493, dated Aug. 31, 2006.

Written Opinion for International Application No. PCT/IB2005/002493, dated Aug. 31, 2006.

Notice of Reasons for Rejection for Japanese Application No. 2007-525381, dated Jan. 11 , 2011.

Japanese Office Action for Application No. 2007-525381, dated Feb. 21, 2012.

* cited by examiner

CASSETTTE LOCKING AND EJECTING ARRANGEMENT

BACKGROUND OF THE INVENTION

1. Field of the Invention

The invention relates to a label printer, and particularly to an arrangement for locking a cassette into a label printer and ejecting it.

2. Related Technology

Label printers which uses a supply of tape, housed in a cassette received in the label printer. The tape comprises an image receiving layer and a backing layer which are secured to one another via an adhesive layer. Such label printers include a cutting mechanism for cutting off a portion of the tape after an image has been printed onto the image receiving layer so that the portion of tape having the image can be used as a label. After the tape has been cut, the cut portion of the tape is pulled from the printer through a slit in the printer housing. The backing layer can then be removed allowing the image receiving layer to be secured to an object using the adhesive layer.

The label printer comprises a cassette receiving bay in which a cassette is received for printing. A print head is provided in the cassette receiving bay for co-operating with the supply of tape to print thereon. A platen may also be provided in the cassette receiving bay positioned at a side of the tape opposite to the print head when the cassette is received in the cassette receiving bay. During printing, the print head co-operates with the platen, with the tape passing therebetween for printing thereon. The platen may be driven by a motor for propagating the tape during printing. Alternatively, the platen may be freely rotatable and an additional drive roller is then provided for driving the tape during printing.

In an alternative arrangement to that described above, a platen may be provided within the cassette. In such an arrangement, the tape cooperates with a surface of the platen. When received in the cassette receiving bay the platen in the cassette co-operates with a drive mechanism in the cassette receiving bay for driving the tape during printing. Alternatively, the platen is freely rotatable and an additional drive roll is provided for driving the tape. During printing, the print head in the cassette receiving bay co-operates with the platen in the cassette with tape passing therebetween for printing thereon.

In one arrangement, the print head is movable between a non-printing position and a printing position. In an alternative arrangement, the platen is movable between a non-printing position and a printing position. In yet another arrangement, both the platen and print head are movable so as to have non-printing and printing positions.

The tape may be of a direct thermal type on which printing is achieved by direct application of heat from printing elements on the print head. Alternatively, an ink ribbon may be provided, whereby ink is transferred from the ribbon to an image receiving tape by application of heat to the ink ribbon via printing elements on the print head. The cassette may include a roll of die cut labels rather than a continuous tape.

In all the above-described arrangements, a problem exists in that for good quality printing the tape and/or ink ribbon must be correctly aligned with the print head during printing. Furthermore, the tape must remain correctly aligned with the print head while printing occurs and must smoothly pass the print head so as to ensure good quality printing, In order to ensure that this is the case, it is advantageous to prevent the cassette from moving during printing. Furthermore, the position of the cassette within the cassette receiving bay should be predefined and readily reproducable whenever a cassette is inserted in the cassette receiving bay.

In existing arrangements, this is achieved indirectly by the provision of one or more longitudinal drive shafts which project from the cassette receiving bay floor and which cooperate with one or more tape/ink ribbon spools and/or a drive roller in the cassette. Locating the cassette on these elongate members results in the cassette position being approximately in the same place whenever a cassette is placed in the cassette receiving bay. However, in such an arrangement, the height of the cassette may vary if the cassette is not fully pushed downwards into the cassette receiving bay. Furthermore, there is a certain amount of free play between the elongate members and the spools in the cassette. Accordingly, the cassette is movable by a small amount within the cassette receiving bay. This can lead to mis-alignment of the tape and print head during printing. Furthermore, if the cassette moves when printing is taking place, the tape may become creased or folded leading to poor print quality and in a worst case scenario the tape may become snagged in the mechanism which can lead to damage of the tape supply and/or the printer.

The problem is exacerbated in hand held printers which may be moved around during printing. In such an apparatus, it is even more important that the cassette is locked in a fixed position during printing.

Two types of cassette locking mechanisms are described in WO 2004/059241. In the arrangement illustrated in FIG. 11*a* of this document, a cassette-receiving bay is shown in which a tape cassette is inserted in a direction perpendicular to the axis of rotation of the supply spool in the cassette. The cassette-receiving bay comprises two plate like members which extend in a direction parallel to the direction of insertion of the cassette. The plate like members cooperate with opposing sides of the cassette. The plate like members are movable whereby they are moved apart to insert the cassette and then moved together to grip the cassette. A sprocket extends from one of said plate like members so as to co-operate with a spool in the tape cassette.

In an alternative arrangement illustrated in FIGS. 15 to 18*c* of WO 2004/059241 a locking ring mechanism and cassette are shown. In the cassette, flanges form a recess for receiving an idler roller of the printer which the emerging tape moves against as shown in FIG. 18. On the outer edge of the cassette profile are two positioning ribs and three fixation ribs. The purpose of the positioning ribs is to prevent the cassette turning in a radial direction when inserted in the printer. The purpose of the fixation ribs is to prevent axial movement of the cassette out of the printer once inserted.

The cassette receiving bay is generally circular in cross-section, with a push plate at one end and open at the other end. The cassette is inserted downwards onto the push plate. An inner side of the cassette receiving bay is formed of a locking ring. An inner surface of the locking ring has grooves for receiving the positioning ribs and fixation ribs of the cassette. A fixed part of the cassette receiving bay is disposed behind the locking ring. In order to insert the cassette, the ribs and the grooves are aligned and the cassette is pushed downwards such that each rib slides along its respective groove. The push plate is supported at its periphery by springs and is movable such that it is pushed downwards as the cassette is inserted.

The locking ring includes an exit slit for the tape so that the tape can exit the cassette-receiving bay past the idler roller. The push plate is connected to the fixed part of the cassette receiving bay and the locking ring is spring loaded in a tangential direction by a spring. As a cassette is pushed into place, the spring urges the locking ring clockwise with respect to the fixed part of the cassette-receiving bay. However the ring cannot rotate under the action of the spring until the cassette is fully inserted. This is because during insertion the fixation ribs hold the grooves open. Rotation of the locking ring locks the cassette in position. When the locking mechanism is released, the push plate urges the cassette in an upward direction ejecting the cassette from the cassette-receiving bay.

SUMMARY OF THE INVENTION

The invention provides an improvement on the locking and ejecting mechanisms described above.

According to a first aspect, the invention provides a label printer comprising a cassette-receiving bay, said cassette-receiving bay having a base, a top opening opposite the base, and a locking mechanism extending from said base, said locking mechanism having a locking part, said locking part being movable in a first direction and biased in a second direction opposite to said first direction, said locking part having one or more projections such that a force thereon directed towards said base causes the locking part to move in the first direction and wherein said locking part is biased to move in said second direction when the force is removed. In one arrangement, said locking mechanism is arranged whereby when a cassette is inserted into the cassette receiving bay, said locking part extend through an opening in a base of the cassette.

According to a second aspect, the invention provides a cassette comprising: a housing having a base and a top; and a recess comprising an opening in the base and an ejector surface positioned between said opening and said top for cooperation with an ejector part extending from a base of a cassette receiving bay of a printer, said ejector surface being arranged to apply a force to the ejector part in a direction towards the base of the cassette receiving bay when the cassette is inserted into the cassette receiving bay moving the ejector part in a direction towards the base of the cassette receiving bay, the recess of the cassette being arranged whereby the ejector part is disposed within the recess of the cassette when the cassette is inserted into the cassette receiving bay.

According to a third aspect, the invention provides a label printer comprising a cassette receiving bay, said cassette receiving bay having a damping mechanism, said damping mechanism extending from a sidewall of the cassette receiving bay for interaction with a gearrack on a sidewall of a cassette.

According to a fourth aspect, the invention provides a label printer comprising a cassette-receiving bay, said cassette-receiving bay having a base, a top opening opposite the base, and side walls extending between the base and the top opening, the label printer further comprising one or more ejector mechanisms, each ejector mechanism comprising an ejecting element extending from a side wall into the cassette-receiving bay, the ejector element being movable in a direction towards the base by a cassette inserted into the cassette-receiving bay and biased in a direction towards the top opening for ejecting a cassette, wherein the ejecting element extends from the side wall part way into the cassette-receiving bay and has a free end unconnected to any other structural elements of the label printer.

According to a fifth aspect, the invention a label printer comprising a cassette receiving bay, said cassette receiving bay comprising a locking ring having a movable portion which is movable in a first direction and biased in a second direction, said movable portion having one or more projections extending radially inwards such that a downward force thereon perpendicular to the first and second directions causes the movable portion of the locking ring to move in the first direction and wherein said movable portion is biased to move in said second direction when the downward force is removed, wherein said movable portion comprises at least two elongate elements being pivotally connected to each other by a pivotal connection having a rotational axis perpendicular to said first and second directions, said one or more projections being on at least one of said at least two elongate elements.

According to a sixth aspect, the invention provides a label cassette comprising a housing, said housing having a base, a top and sides, and a locking feature disposed on a side of the housing for cooperation with a locking mechanism in a label printer, said locking feature comprising a groove extending in a direction from the base to the top and a locking chamber at a top end of said groove, the groove having a sloped surface at an angle between 0 and 90° relative to the base and the locking chamber having a wall portion positioned over said sloped surface.

According to a seventh aspect, the invention provides a method of loading and ejecting a label cassette in a label printer having a cassette receiving bay, an ejector mechanism and a damping mechanism, said cassette being inserted into said cassette receiving bay in a first direction and ejected from said cassette receiving bay by said ejector mechanism in a second direction, said method comprising damping movement of said cassette in said first and second directions during insertion and ejection of said cassette respectively.

BRIEF DESCRIPTION OF THE DRAWINGS

For a better understanding of the invention and to show how the same may be carried into effect, reference will now be made by way of example to the accompanying drawings in which.

DETAILED DESCRIPTION OF EMBODIMENT OF THE INVENTION

Figure 1:
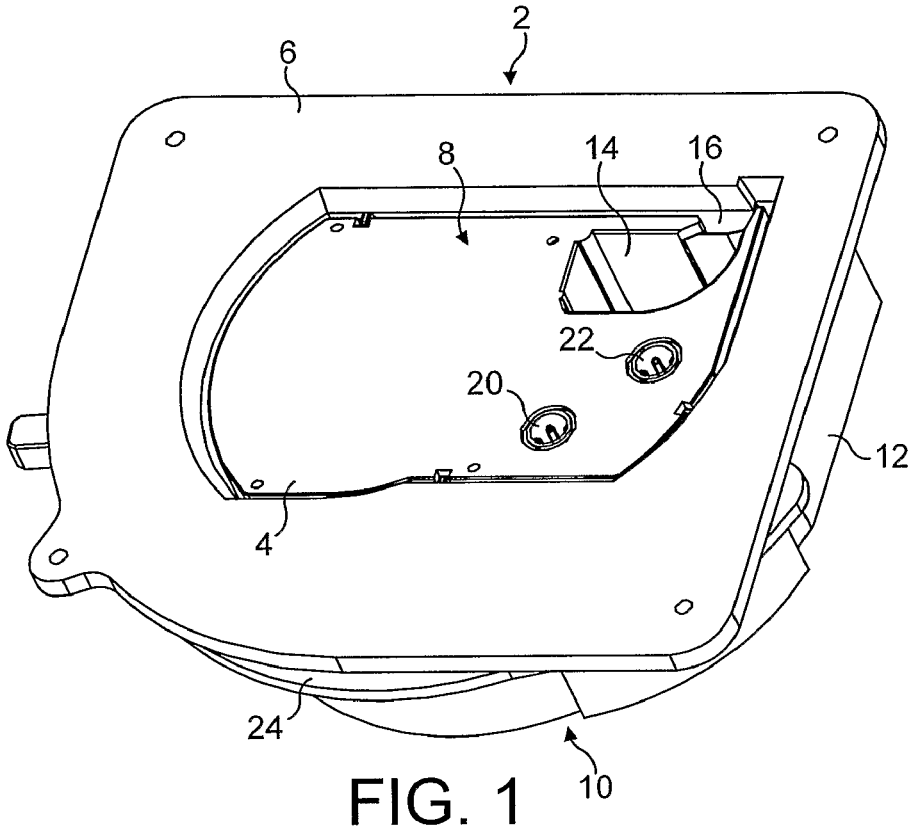
FIG. 1 is a top perspective view of a cassette receiving bay having a cassette loaded therein.

FIG. 1 shows a top perspective view of a cassette receiving bay 2 with a cassette 4 inserted therein. The cassette receiving bay 2 comprises an upper flange 6 having a recess therein forming an opening 8 for receiving the cassette 4. The cassette receiving bay 2 comprises a base 10 and sides 12 extending from the base 10 to the opening 8. The cassette 4 comprises a housing having a recess 14 therein for receiving a print head and/or platen when the cassette 4 is mounted in a label printer. An opening 16 is provided on a side of the label cassette 4 across which tape passes for co-operation with a print head and a platen in the conventional manner. The illustrated cassette 4 comprises an ink ribbon supply spool 20 and an ink ribbon take up spool 22. A tape supply spool is also housed within the cassette 4. The ink ribbon passes in co-operation with the print receiving tape across the opening for printing. A locking ring 24 is provided for locking the cassette 4 in a printing position within the cassette receiving bay 2.

Figure 2:
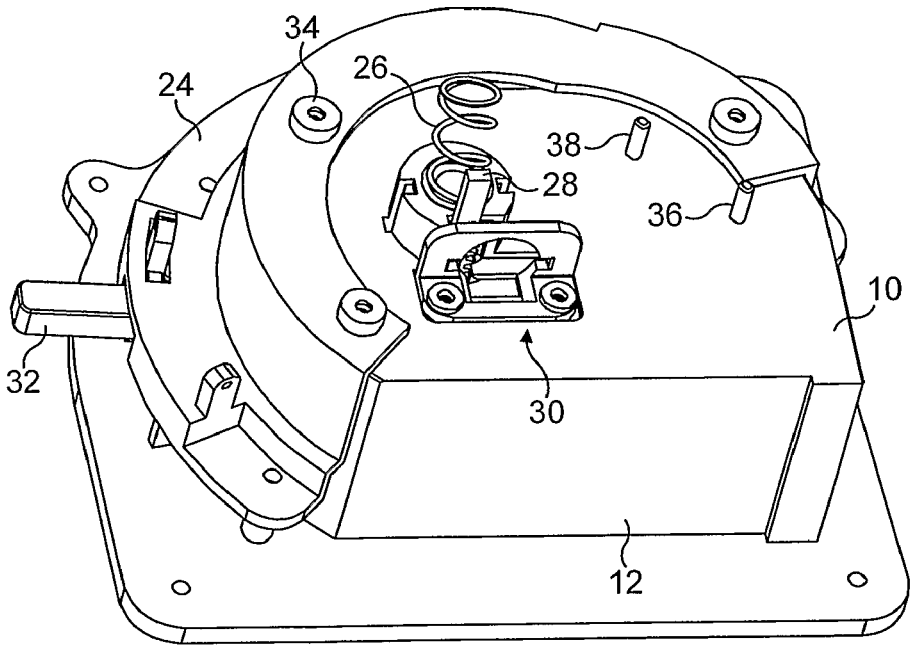
FIG. 2 is a bottom perspective view of the cassette receiving bay of FIG. 1.

The locking ring 24 can be seen in more detail in FIG. 2 which shows a bottom perspective view of the cassette receiving bay 2. A spring 26 is illustrated for biasing an ejector in a direction opposite to the direction of insertion of the cassette 4. A gearrack 28 is provided on a lower portion of the ejector which co-operates with a damper mechanism 30. The locking ring comprises a portion which is fixed relative to the cassette receiving bay 2 and another portion which is rotatable with respect to the fixed portion, the rotatable portion having a lever 32 for rotating said portion. The fixed portion has connectors 34 for fixedly connecting to the cassette receiving bay. The base of the cassette receiving bay has an opening therein for receiving the spring. A further opening is provided for receiving the gearrack 28 of the ejector. The damper mechanism 30 is fixedly mounted to a lower surface of the base of the cassette receiving bay located so as to cooperate with the gearrack 28 of the ejector. Lower portions of two sprockets 36, 38 extend through the base of the cassette receiving bay.

Figure 3:
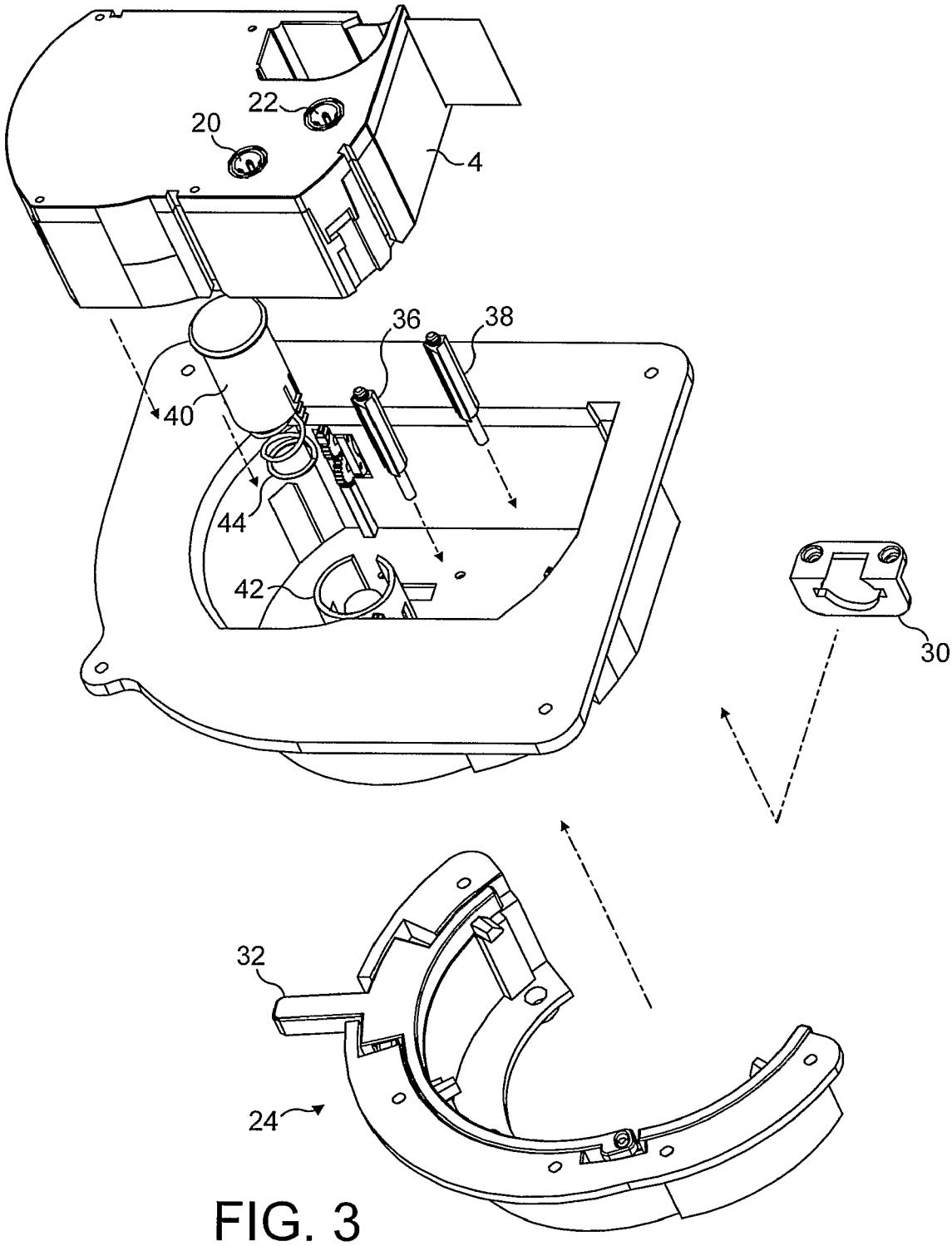
FIG. 3 is an exploded view of the cassette and the cassette receiving bay shown in FIGS. 1 and 2.

FIG. 3 shows an exploded view of the cassette receiving bay 2, the locking ring 24, the damper mechanism 30 and the label cassette 4. The ejector 40 is mounted in a housing 42 on the base of the cassette receiving bay 2. The ejector is cylindrical in shape having an upper surface for co-operation with the cassette. A spring 44 is mounted between the ejector and the base of the cassette receiving bay for biasing the ejector 40 in a direction opposite to the insertion of the cassette 4. Two elongate sprockets 36, 38 are mounted on the base of the cassette receiving bay for co-operation respectively with the ink ribbon take up and supply spools 20, 22 of the cassette. The locking ring 24 is mounted to a side of the cassette receiving bay. A damper mechanism 30 is mounted to a lower surface of the base of the cassette receiving bay.

Figure 4:
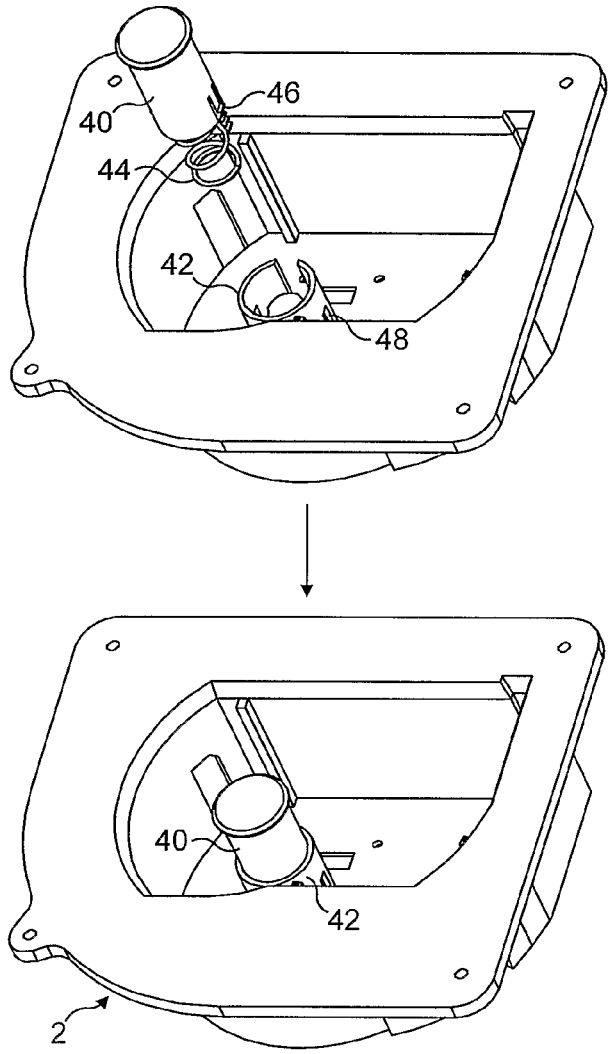
FIG. 4 illustrates the construction of an ejector.

FIG. 4 illustrates the mounting of the ejector 40 on the base of the cassette receiving bay. A cylindrical housing 42 on the base is provided for holding and aligning the ejector 40. An outer surface of the ejector has a fastening mechanism 46 (in this case a click/snap fit fastening mechanism) for cooperation with an opening 48 in the ejector housing 42 so as to attach the ejector 40 to the cassette receiving bay and prevent the spring 44 pushing the ejector 40 fully out of the housing. The click fastening mechanism 46 and the opening in the ejector housing 48 are arranged such that the ejector is movable in a downwards direction against the spring 44. When released, the spring urges the ejector in an upwards direction until the fastening mechanism co-operates with the upper portion of the opening. In the present embodiments, the ejector has a stroke of 20 mm.

Figure 5:
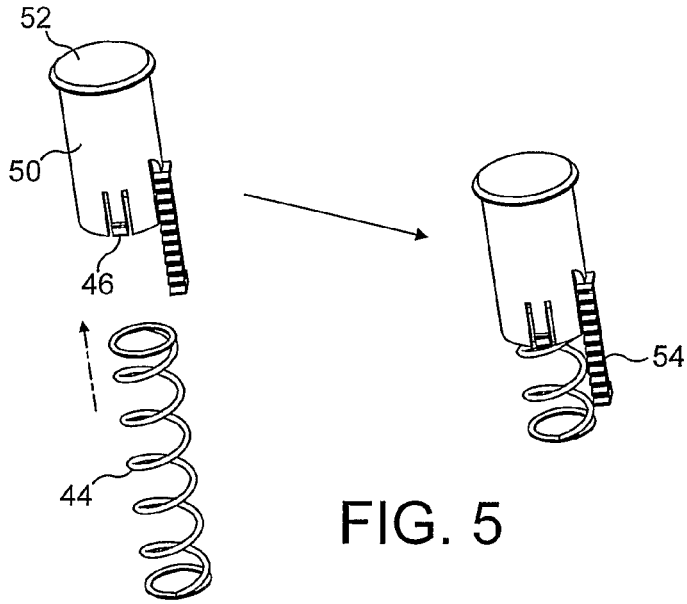
FIG. 5 shows the structure of the ejector in more detail.

FIG. 5 shows the ejector mechanism in more detail. The ejector comprises a cylindrical body 50 having an upper surface 52 for cooperation with a lower surface of a cassette. An elongate gearrack 54 extends from a lower portion of the ejector body 50 for cooperation with the damper mechanism 30. The fastening mechanism 46 which co-operates with the ejector housing in the cassette receiving bay is clearly visible. In the illustrated embodiment, this comprises a snap fit mechanism. An ejector spring 44 cooperates with a lower surface of the ejector body for biasing the ejector in a direction opposite to the direction of insertion of a cassette.

The ejector of the present arrangement is a plunger rather than a push plate as described in WO 2004/059241. One key feature of embodiments of the present invention is that the ejector is located between the side walls of the cassette receiving bay, located away/spaced from the side walls, and preferably located approximately centrally in the cassette receiving bay for cooperation with a cassette housing when a cassette is inserted into the cassette receiving bay. The ejector extends from the base of the cassette receiving bay in a vertical direction between the base and the top opening of the cassette receiving bay, the upper surface of the ejector part being located between the base and the top opening.

The above-described ejector is simple in construction and easy to manufacture. The mechanism is also compact for use in small handheld printers. In particular, because the ejector of embodiments of the invention is arranged to extend from the base of the cassette receiving bay and through an opening in the base of the cassette (described in more detail later), the need for providing mounting and biasing means around the periphery of the cassette receiving bay as with a push plate is avoided. That is, ejectors according to embodiments of the present invention are substantially located within the cassette when the cassette is loaded into the printer rather than outside the cassette acting on an outer surface thereof. This results in a reduction in the size of the device.

In the presently described embodiment, the ejector mechanism comprises an ejector part and a spring disposed between the ejector part and the base of the cassette receiving bay. However, in its simplest form that ejector of the present invention may be merely a biasing means such as a spring arranged to extend from the base of the cassette receiving bay and through an opening in the base of the cassette.

In the presently described embodiment, the base of the cassette and the base of the cassette receiving bay are perpendicular to the spool on which the tape is mounted. In an alternative arrangement in which the cassette is laterally inserted into the cassette receiving bay, the base of the cassette and the base of the cassette receiving bay are parallel to the spool on which the tape is mounted.

Figure 6:
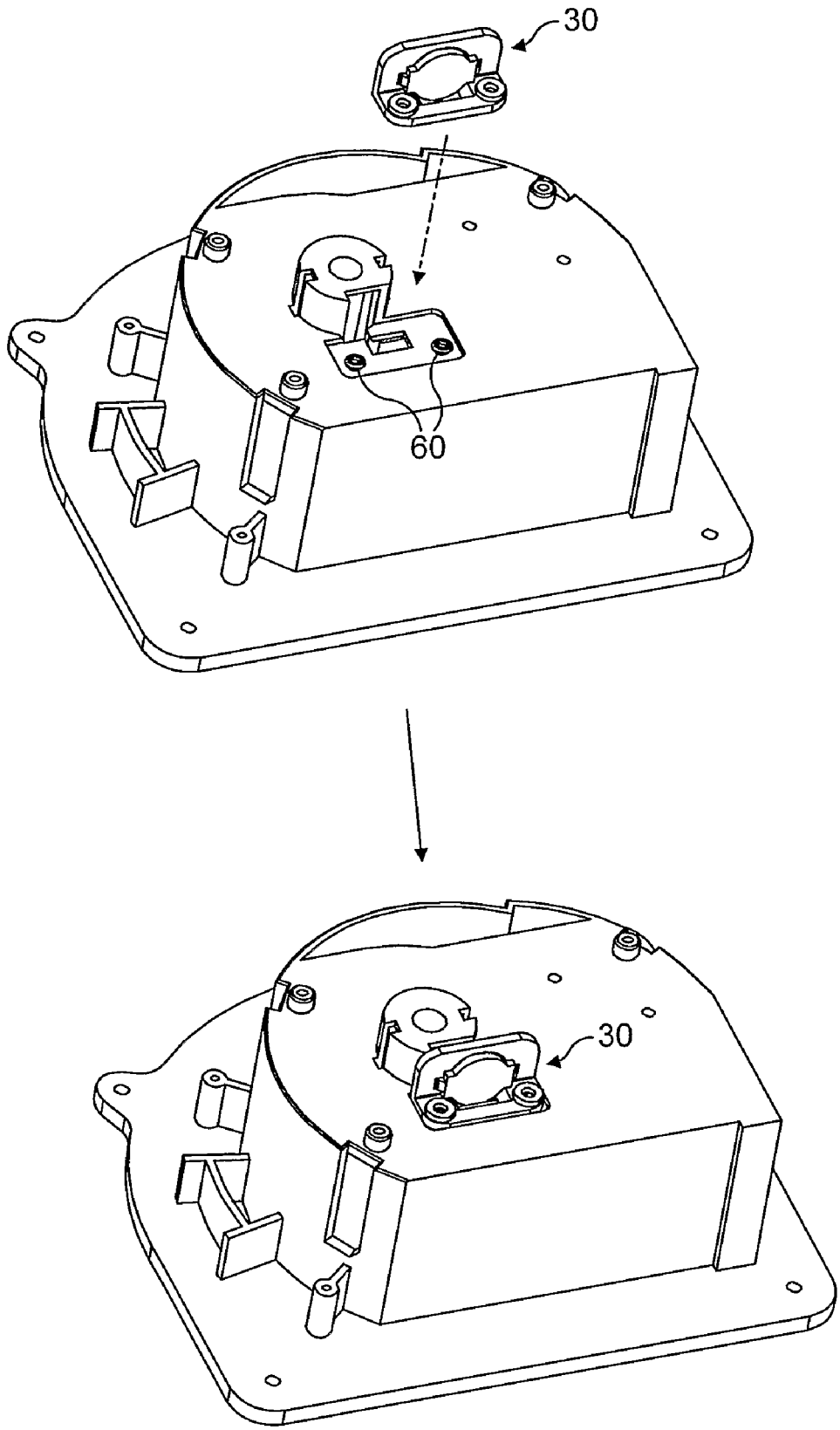
FIG. 6 shows the underside of the cassette receiving bay and illustrates the construction of a damping mechanism.

FIG. 6 shows a bottom perspective view of the cassette receiving bay. Attachment of the damper mechanism 30 is illustrated. Fixation posts 60 are provided on a lower surface of the base of the cassette receiving bay for attachment of the damper mechanism.

Figure 7:
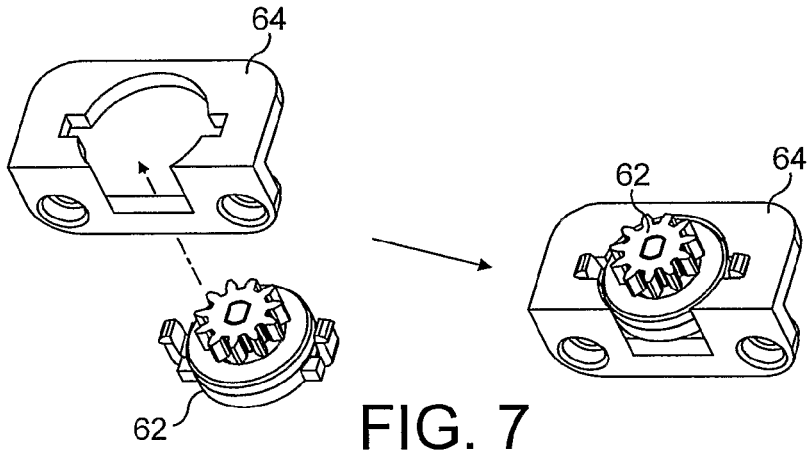
FIG. 7 shows the damping mechanism in more detail.

FIG. 7 shows the damper mechanism in more detail. The mechanism comprises a damper 62 and a holder 64 for attachment to the lower surface of the base of the cassette receiving bay. The damper snaps into the holder via two snap fit mechanisms.

Figure 8:
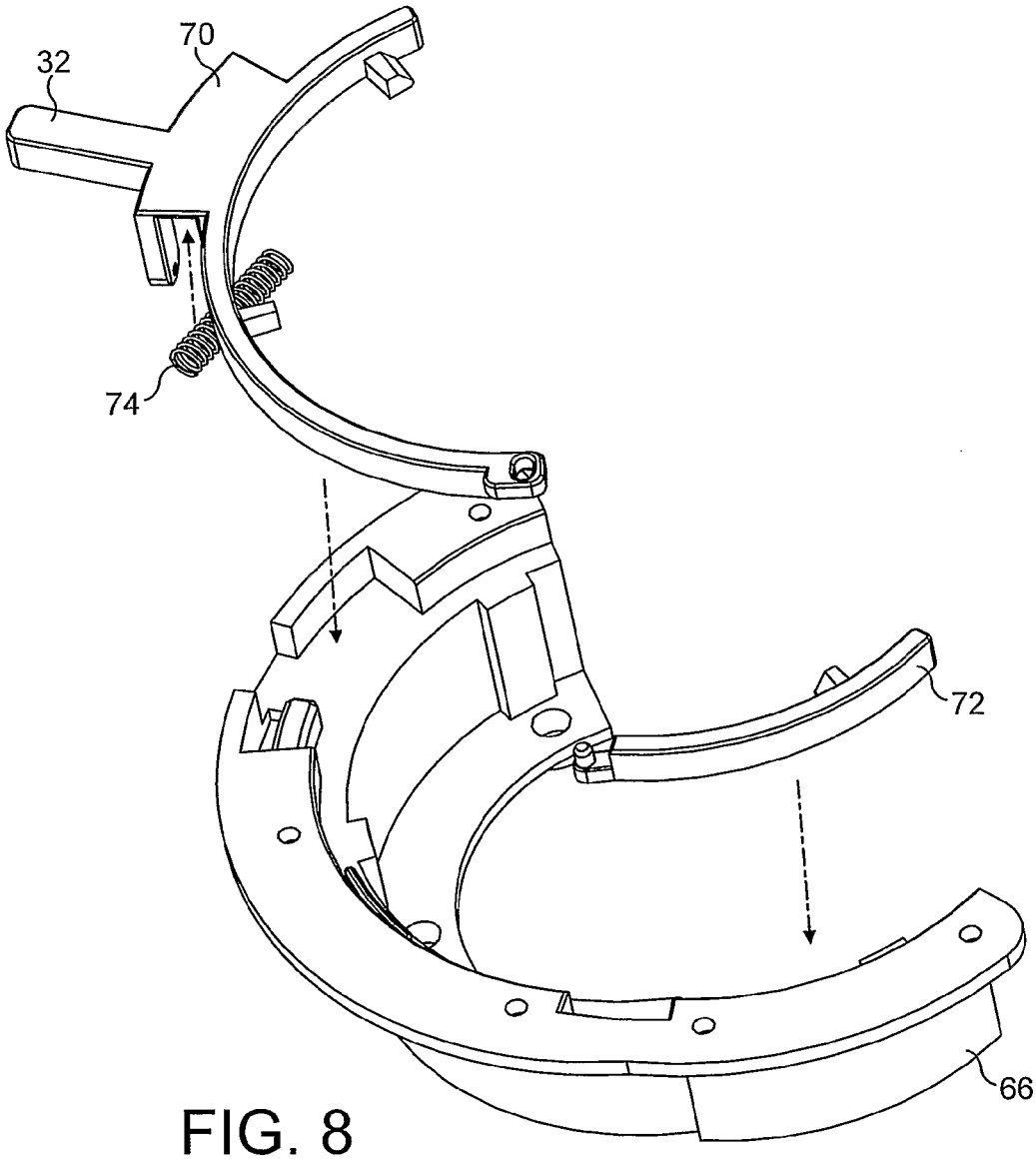
FIG. 8 shows an exploded view of a portion of the locking ring.

FIG. 8 shows an exploded view of the locking ring. The locking ring comprises a fixed frame 66 for mounting a movable ring thereon. The movable ring comprises two parts: a locking ring master 70 and a locking ring slave 72. A locking ring spring 74 is attached to the locking ring master 70 and the fixed frame 66 for biasing the movable ring in a clockwise direction relative to the fixed frame 66. The locking ring master 70 is provided with a lever 32 for rotating the movable ring relative to the sliding frame.

The feature that the movable portion of the locking ring has more than one part, and that these parts are movable relative to each other, allows the locking mechanism to fit with cassettes of varying shape.

Figure 9:
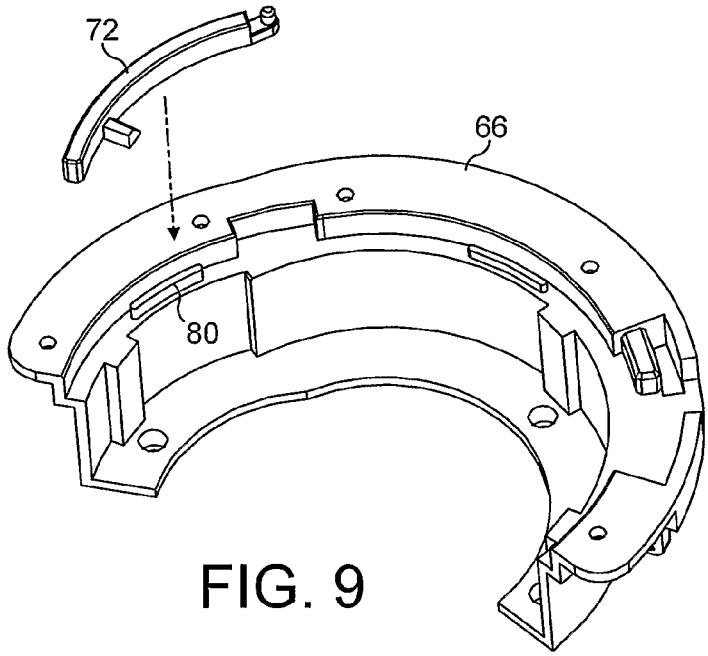
FIG. 9 shows another exploded view of a portion of the locking ring.

FIG. 9 shows another view of the locking ring. The locking slave 72 is positioned on the fixed frame 66. A guide rib 80 is provided for mounting and aligning the locking ring slave 72.

Figure 10:
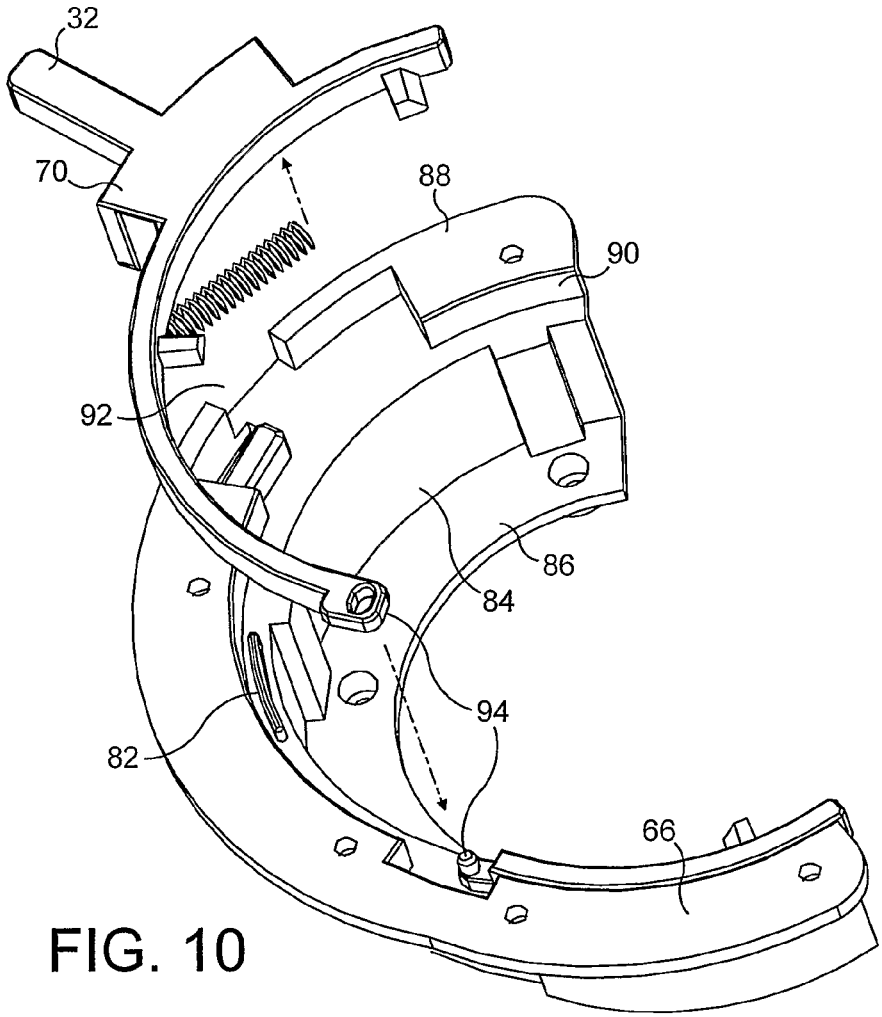
FIG. 10 shows yet another exploded view of a portion of the locking ring.

FIG. 10 shows a further illustration of the locking ring. A guide rib 82 is provided for the locking ring master 70 so as to mount and align the locking ring master on the fixed frame 66.

The fixed frame 66 has a substantially cylindrical portion 84 and a lower flange 86 and an upper flange 88 for attachment to the cassette receiving bay. A step portion 90 is provided between the upper flange 88 and the cylindrical portion 84 for receiving the movable ring thereon. Guide ribs 82 are provided on the step portion for aligning the movable ring. An opening 92 in the upper flange is provided for the lever 32 of the locking ring. A link 94 is provided between the master locking ring and the slave locking ring. The link 94 comprises a projection on the slave locking ring and a recess in the master locking ring for receiving said projection although the alternate arrangement is, of course, envisaged. The link 94 provides a rotatable connection between the master and slave locking rings. All parts of the movable ring are mounted onto the fixed frame with the master and the slave locking rings being located on the guide features and linked together, the movable ring being biased in a clockwise direction by the spring.

Figure 11:
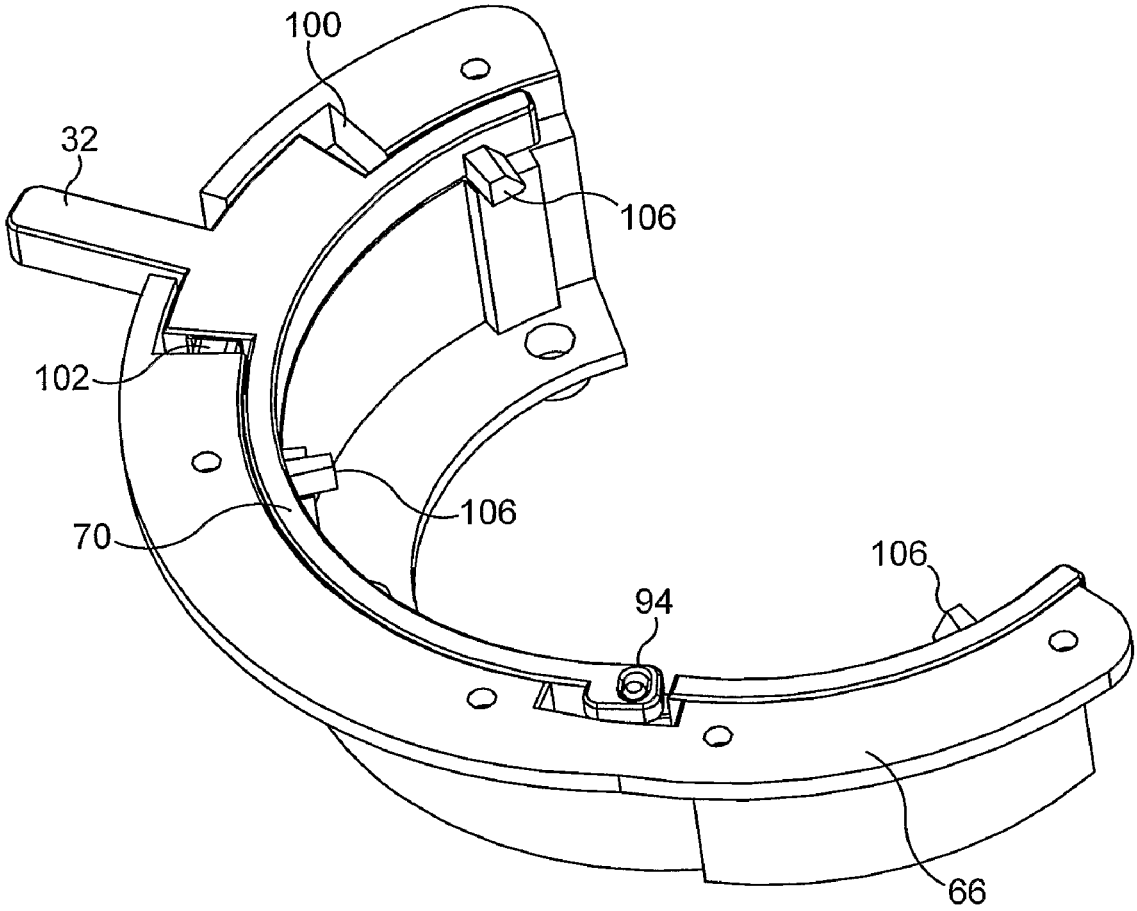
FIG. 11 shows the fully constructed locking ring.

FIG. 11 shows a top perspective view of the movable ring 70 mounted on the fixed frame 66. The lever 32 extends radially outward through an opening in the upper flange 88. The lever 32 abuts surfaces 100, 102 of the fixed frame 66 to limit the rotation of the movable ring 70. One or more projections 106 are provided on the movable ring 70 extending radially inwards for co-operation with a cassette. The locking ring 70 is shown in the closed configuration. To open the ring, a rotation of approximately four degrees is needed. The link 94 between the master locking ring and the slave locking ring ensures a fixed connection between both rings.

Figure 12:
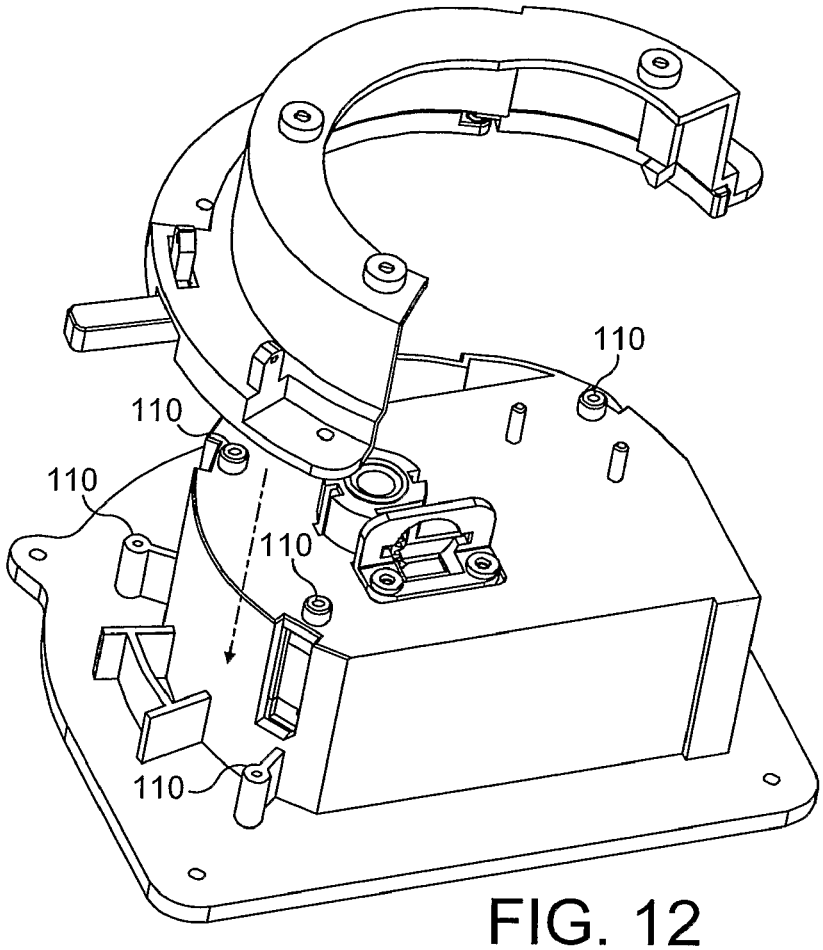
FIG. 12 illustrates how the locking ring is mounted on a side surface of the cassette receiving bay.
Figure 13:
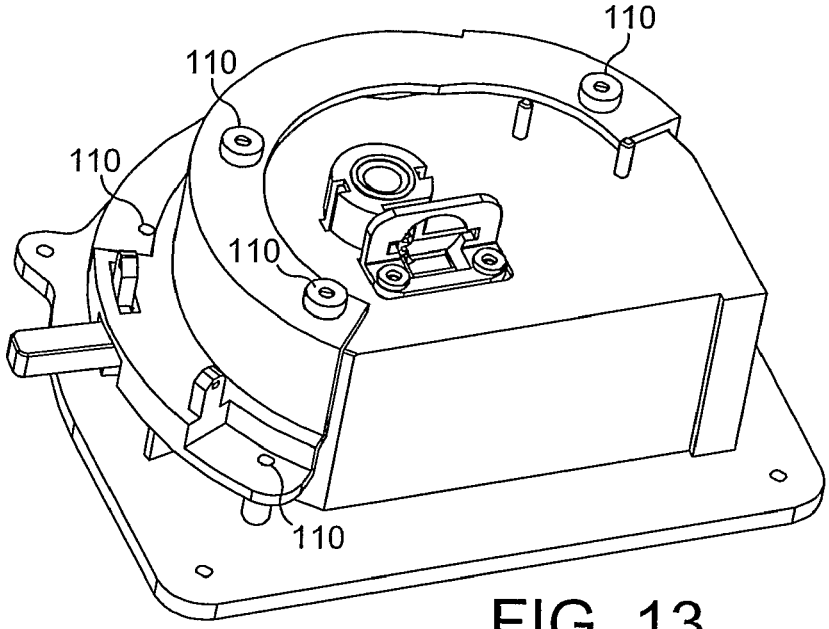
FIG. 13 illustrates the locking ring mounted on a side surface of the cassette receiving bay.

FIG. 12 shows the locking ring being mounted to the cassette receiving bay. Fixation posts 110 are provided on a lower surface of the base and a lower surface of the upper flange of the cassette receiving bay for mounting the locking ring as illustrated in FIG. 13.

Figure 14:
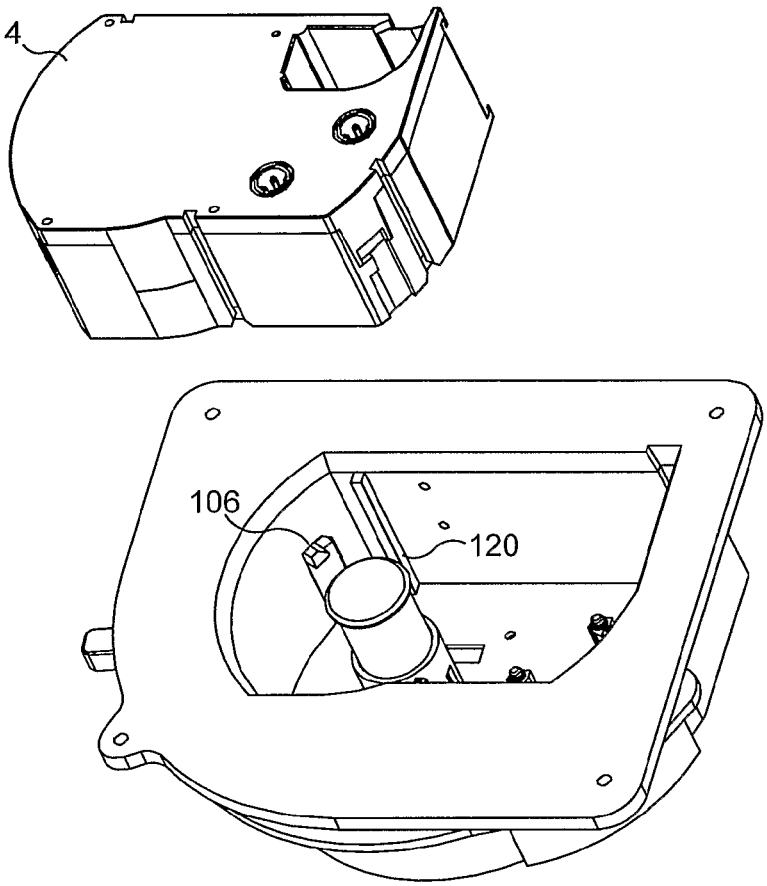
FIG. 14 illustrates the insertion of a cassette into the cassette receiving bay.

FIG. 14 illustrates insertion of the cassette 4 into the cassette receiving bay. The projections 106 of the locking ring extend radially inwards to cooperate with the cassette housing. Also provided in the cassette receiving bay is an elongate guide 120 on a side of the cassette receiving bay for aligning and fixing the cassette in position.

Figure 15:
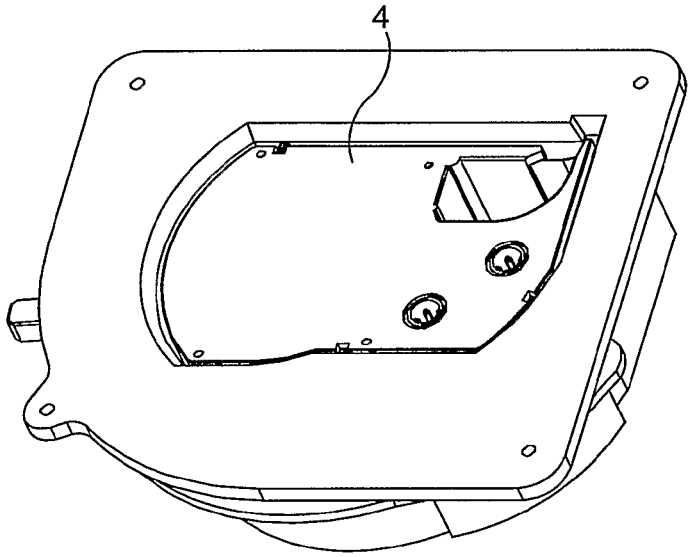
FIG. 15 illustrates the cassette inserted into the cassette receiving bay.

FIG. 15 illustrates the cassette 4 mounted in the cassette receiving bay.

The cassette is centered by means of pressure of the ejector spring and by the projections of the locking ring. During insertion, the projections cooperate with a sloped surface of a locking feature on the cassette housing (discussed later). During insertion each locking feature on the cassette housing pushes on an angled surface of a locking ring projection forcing the locking ring in an anticlockwise direction against the spring force. After the sloped surface on the cassette housing has passed below the locking ring projection, the spring forces the locking ring in a clockwise direction moving the locking ring projections to a position above the sloped surfaces on the cassette housing preventing the cassette from moving in an upwards direction. By moving the lever of the locking ring in an anti clockwise direction, the locking ring projections are moved from a position above the sloped surfaces on the cassette housing to a position adjacent the sloped surfaces. The cassette is then free to move in an upward direction under the influence of the ejector. In a preferred embodiment the projections of the locking ring are trapezoidal or approximately trapezoidal in cross-section.

Figure 16:
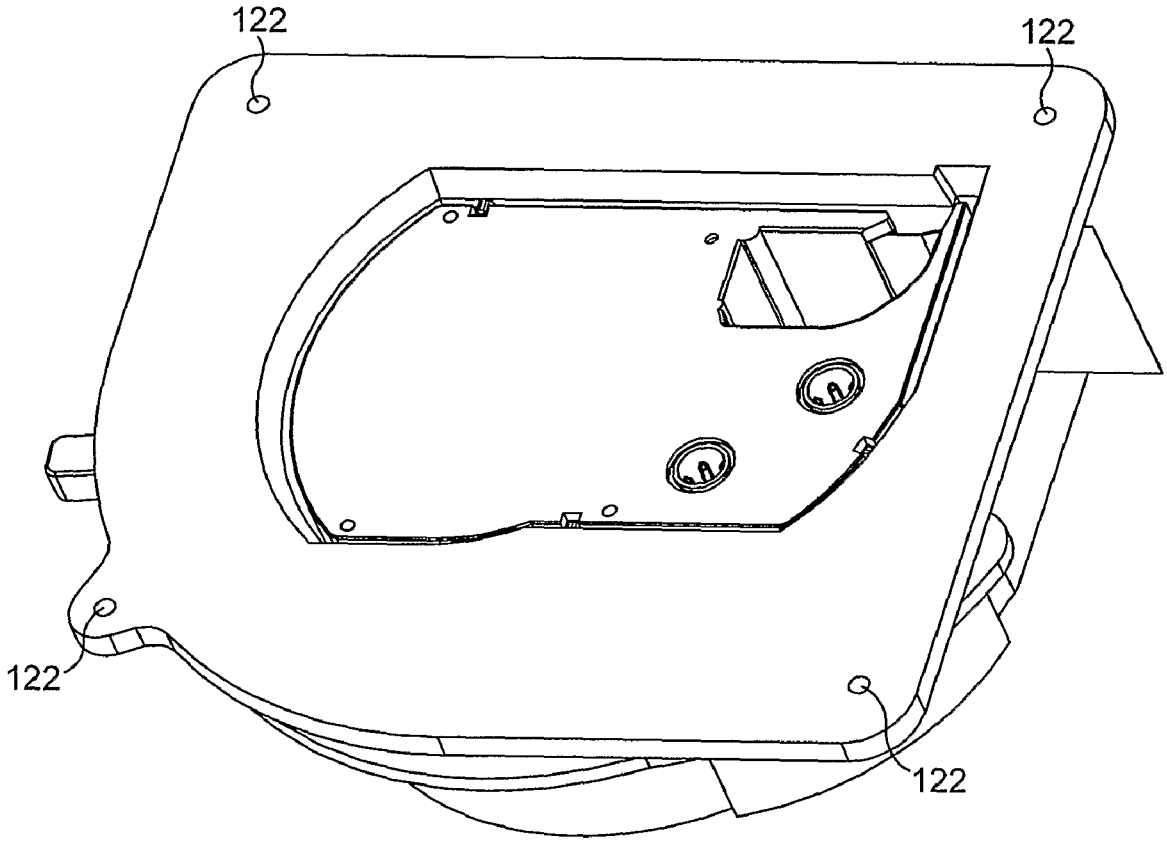
FIG. 16 illustrates mounted holes on a cassette receiving bay for mounting to a printer body.

FIG. 16 shows a perspective view of the cassette receiving bay with a cassette mounted therein. Mounting holes 122 are provided on the upper flange of the cassette receiving bay for attachment to a printer housing.

Figure 17:
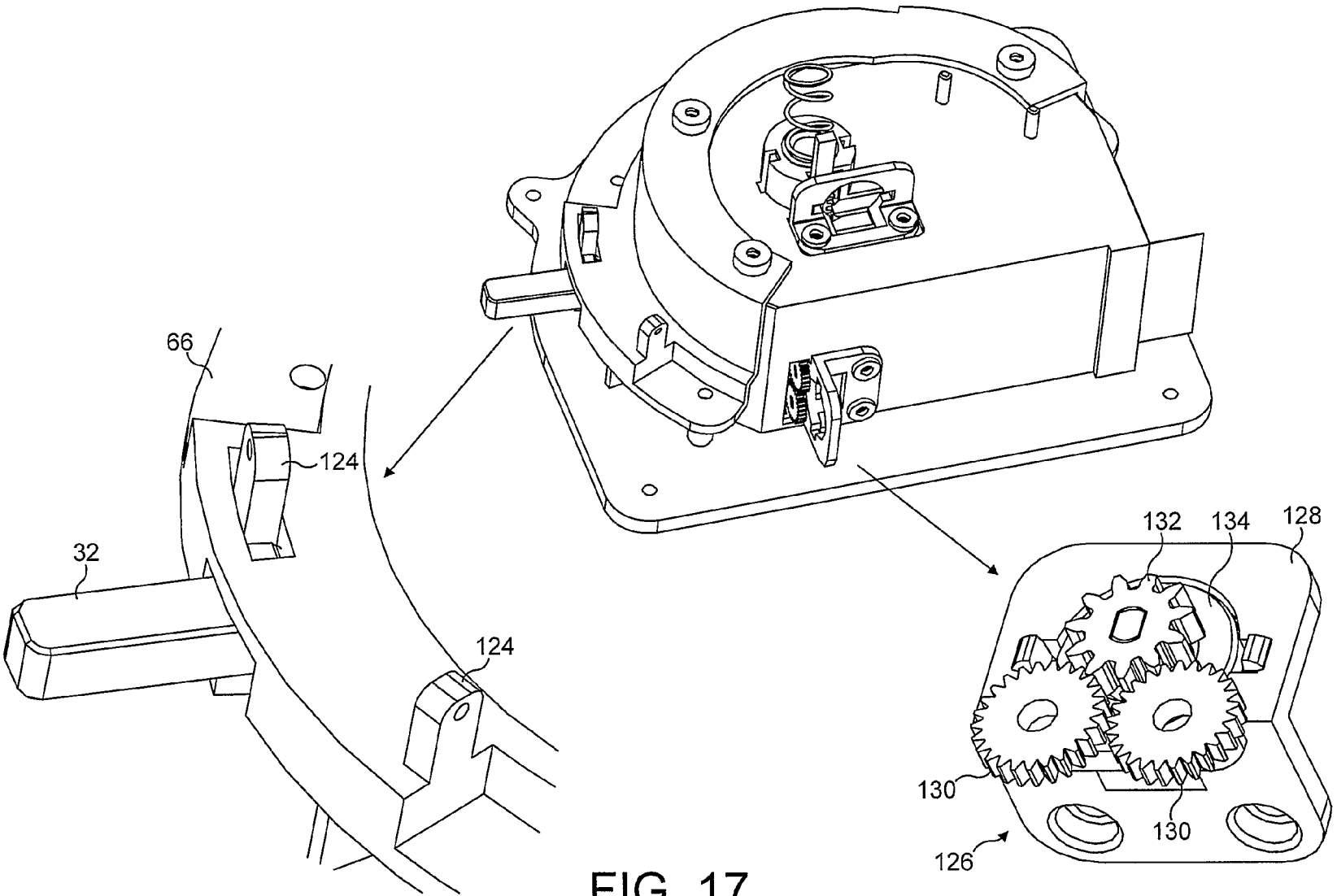
FIG. 17 shows a bottom perspective view of the label printer showing ribs for a tension spring and a damping mechanism.
Figure 18:
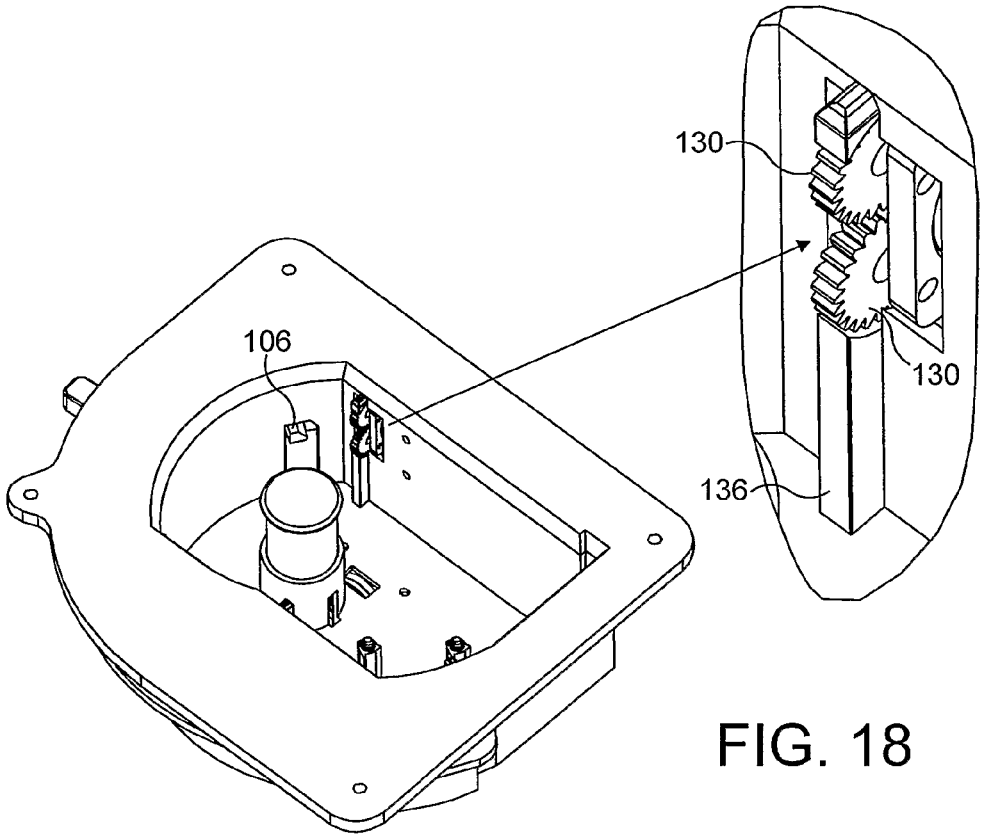
FIG. 18 illustrates the damping mechanism in more detail.

FIG. 17 shows a bottom perspective view of the cassette receiving bay. An attachment portion 124 is provided on the lever 32 of the locking ring and an attachment portion is provided on the fixed frame 66 for attachment of a spring therebetween to bias the movable ring. A further damping mechanism 126 is mounted to a side of the cassette receiving bay. The damping mechanism comprises a mounting frame 128 on which two gears 130 and a further damping gear 132 are rotatably connected. The two gears 130 and the damping gear 132 in the present arrangement are mounted to an intermediate portion 134 which snap fits into the mounting frames 128. This allows for easy construction and replacement of parts. When the damping mechanism 126 is mounted to the side of the cassette receiving bay, the two gears 130 project though an opening in the side of the cassette receiving bay so as to cooperate with a gearrack on the side of a cassette received in the bay. This is illustrated in more detail in FIGS. 18 and 19.

In the illustrated arrangement, the damping mechanism 126 is incorporated into an elongate guide member 136. The gears 130 of the dampening mechanism extend though the side of the bay and are aligned with the elongate member 136 and project slightly further into the bay than the elongate member for cooperation with a gearrack 138 of a cassette. This mechanism provides additional protection for the cassette as it provides a controlled ejection. This damping mechanism may be provided in conjunction with the ejector damping mechanism or as an alternative to the ejector damping mechanism. If this damping mechanism is provided as an alternative to the ejector damping mechanism then the overall height of the arrangement can be reduced by dispensing with the damping mechanism mounted on the low surface of the base of the cassette receiving bay.

Figure 19:
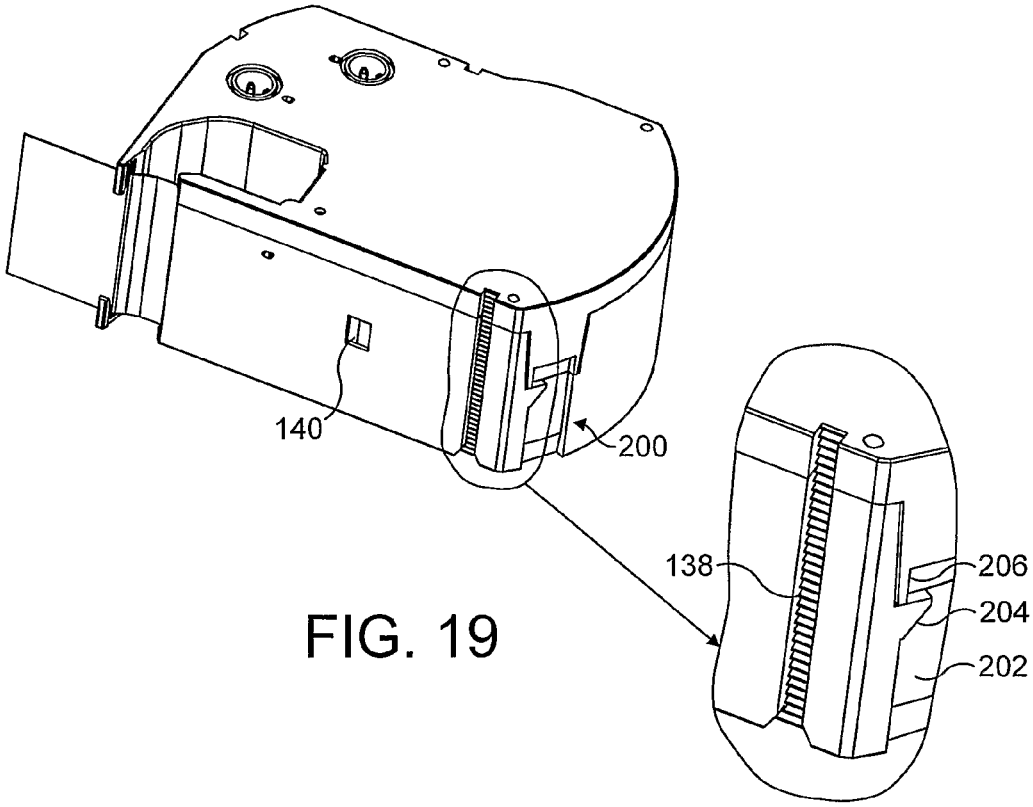
FIG. 19 shows a perspective view of a cassette having a gear rack on a side thereof for cooperation with the damping mechanism in the cassette receiving bay.

FIG. 19 illustrates a cassette in which a gearrack 138 is provided on one side of the cassette for interaction with the dampening mechanism. The gearrack 138 is set in a recess. The recess is for alignment with the elongate guide member 136 on the side of the cassette receiving bay. The gearrack 138 interacts with the gears 130 of the dampening mechanism which are incorporated in and aligned with the elongate guide member 136. The gears 130 of the damping mechanism must extend outward from the elongate guide member 136 to interact with the gearrack 138. The width and depth of the elongate recess in the cassette is equivalent to the width and depth of the elongate guide member 138 in the cassette receiving bay.

Also illustrated in FIG. 19 is an aperture 140 for identifying die cut labels within the cassette and a locking feature 200 disposed on the side of the cassette for cooperation with a projection 106 of the locking ring. The locking feature 200 comprises a groove 202 having a complementary sloped surface 204 for cooperation with the sloped surface of the projection 106. The sloped surface 206 is at an angle of between 0 and 90° (more preferably between 10 and 50°) relative to the direction of insertion and the rotational axis of the supply spool. On insertion of the cassette, the sloped surfaces abut and slide relative to each other as the cassette is pushed downwards with the locking ring rotating in a first direction due to the downward force imparted by the sloped surface 204 of the locking feature on the sloped surface of the projection 106. A locking chamber 206 is provided at an end of the groove 202. As the projection 106 passes into the chamber on insertion of the cassette, the locking ring is biased to rotate in a second direction opposite to the first direction to lock the cassette in place. The locking chamber 206 comprises a horizontal wall portion 208 (perpendicular to the direction of insertion and the rotational axis of the supply spool) positioned vertically above the sloped surface which prevents the cassette from being pushed out of the cassette-receiving bay by the ejector mechanism.

Figure 20:
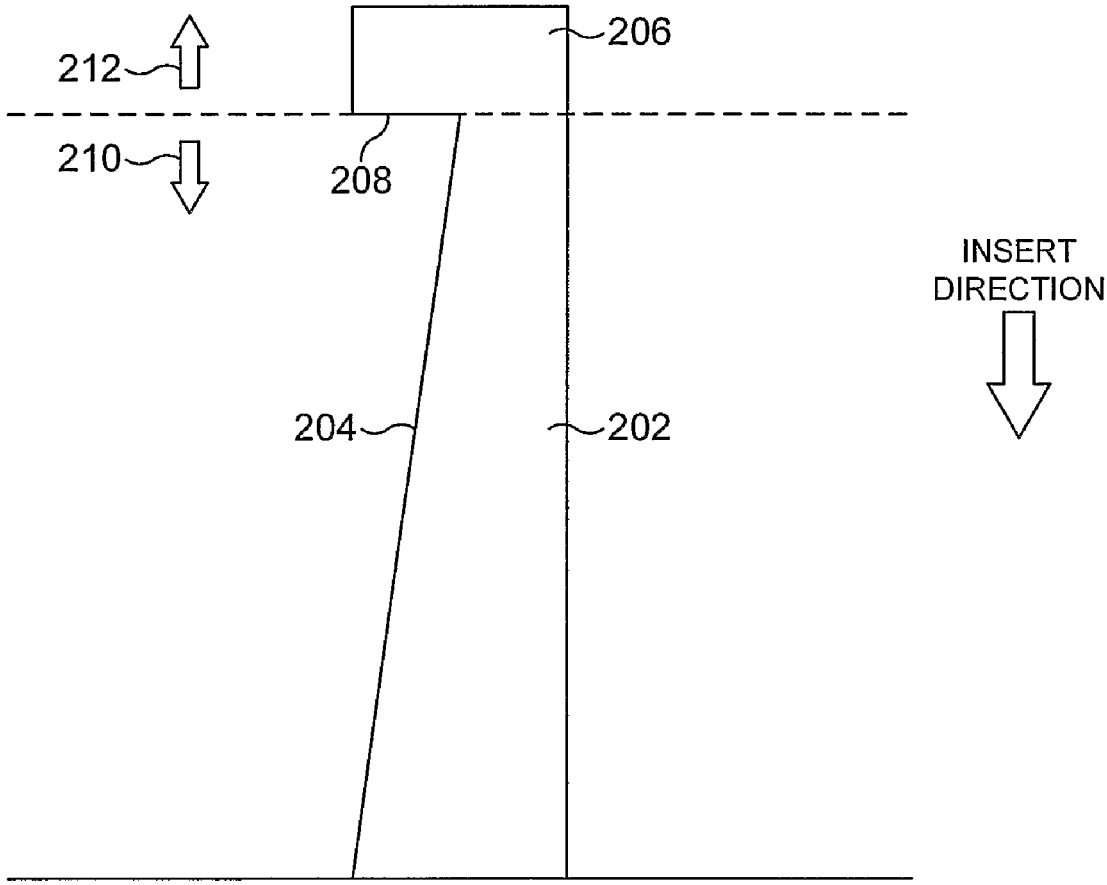
FIG. 20 shows a schematic diagram of a locking feature on the cassette.

A schematic diagram of the locking feature of the cassette is shown in FIG. 20. The schematic diagram illustrates the groove 202 in a side of the cassette, the groove having a sloped surface/wall 204 for opening the locking ring when the cassette is inserted into the label printer (direction of insertion into the label printer is indicated). It is advantageous to provide the cassette housing in two parts (or casings) 210, 212 which fit together as illustrated by the dotted line in FIG. 20 to form the cassette housing. In this case, the locking groove 202 can be provided in a first part 210 of the cassette housing and the locking chamber 206 can be provided in a second part 212 of the cassette housing. By providing the groove and the locking chamber on separate parts, the moulds for the housing of the cassette housing are less complex.

The position of the locking chamber in the width direction of the cassette determines the position of the cassette in the direction of insertion. For cassettes of different width, the position of the locking chamber may be varied such that the centre-line of the image receiving medium is aligned with the centre-line of the print head.

The guiding grooves have two functions: first to position the cassette and second to guide the cassette during insertion.

Figure 21:
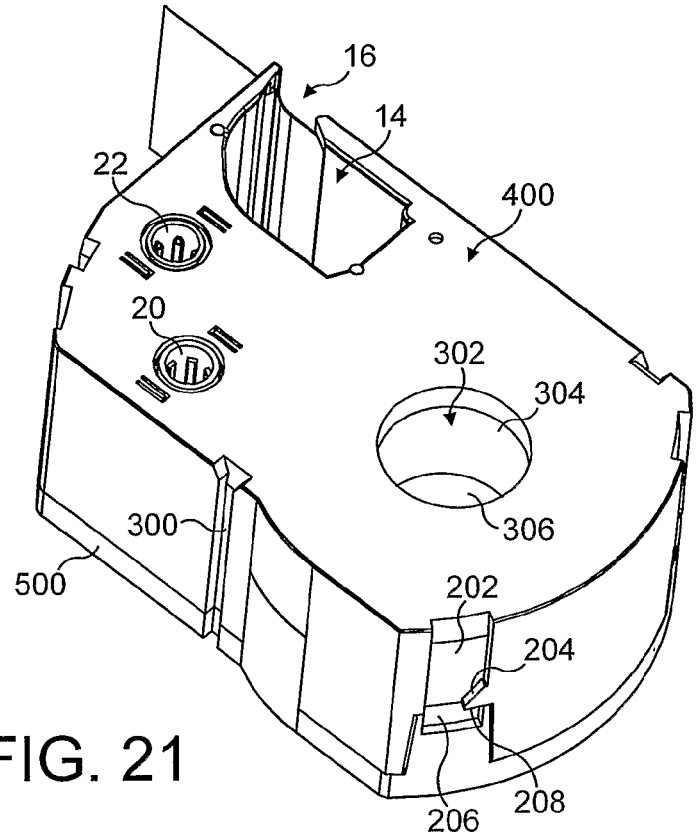
FIG. 21 shows a bottom perspective view of the cassette.

FIG. 21 shows a bottom perspective view of the cassette. The cassette comprises a lower casing 400 and an upper casing 500. The lower casing has an opening 302 therein forming a recess with side walls 304 and a recess base 306. In the present arrangement the recess is cylindrical in shape for cooperation with the cylindrical body of the ejector. The shapes of the ejector and recess are complementary for aiding alignment. The opening 302 may have a funneled shaped entrance having sloped surfaces to aid in guiding the ejector into the recess. As the cassette is inserted into the cassette-receiving bay the recess base abuts a top surface of the ejector pushing the ejector in a downward direction towards the base of the cassette-receiving bay. The locking ring cooperates with the locking feature 202, 204, 206, 208 so as to lock the cassette in the cassette-receiving bay with the ejector disposed in the recess. On releasing the locking ring, the ejector pushes against the recess base 306 thus ejecting the cassette.

An elongate recess 300 is provided on a side of the cassette housing for cooperating with a guide rib in the cassette-receiving bay. The ink ribbon supply spool 20 and the ink ribbon take up spool 22 are also illustrated as is the recess 14 for receiving a printhead or platen and the opening 16 across which tape passes for cooperation with the printhead and platen.

Figure 22:
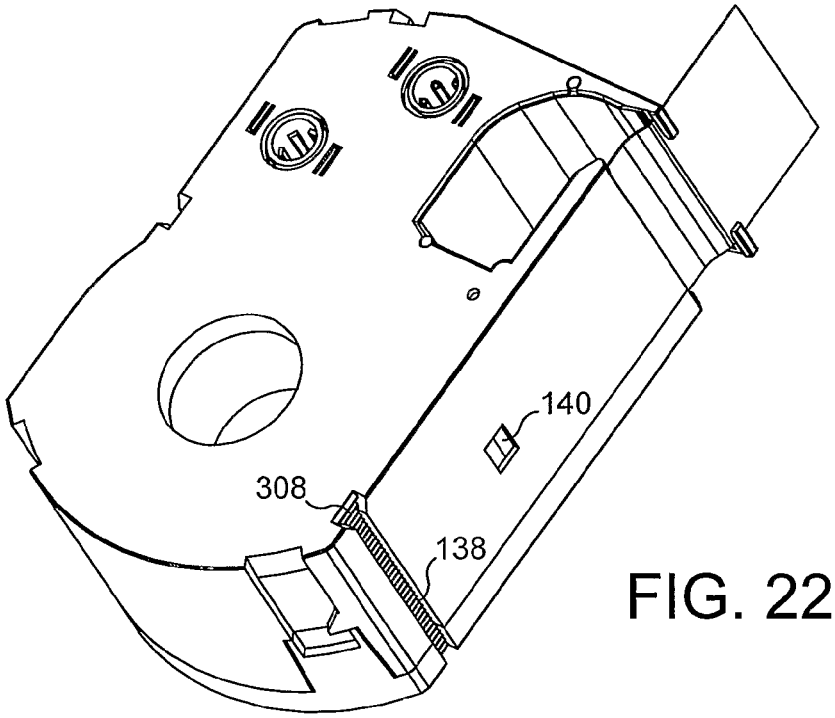
FIG. 22 shows another bottom perspective view of the cassette from a different angle to that shown in FIG. 21.

FIG. 22 shows another bottom perspective view of the cassette from a different angle to that shown in FIG. 21. The elongate recess having the gearrack 138 therein is clearly visible. The elongate recess has a funnel shaped portion at a bottom end thereof having angled surfaces for cooperation with the gears 130 of the damping mechanism to aid in aligning the gears with the gearrack. Also illustrated is the aperture/window 140 for identifying die cut labels within the cassette.

Figure 23:
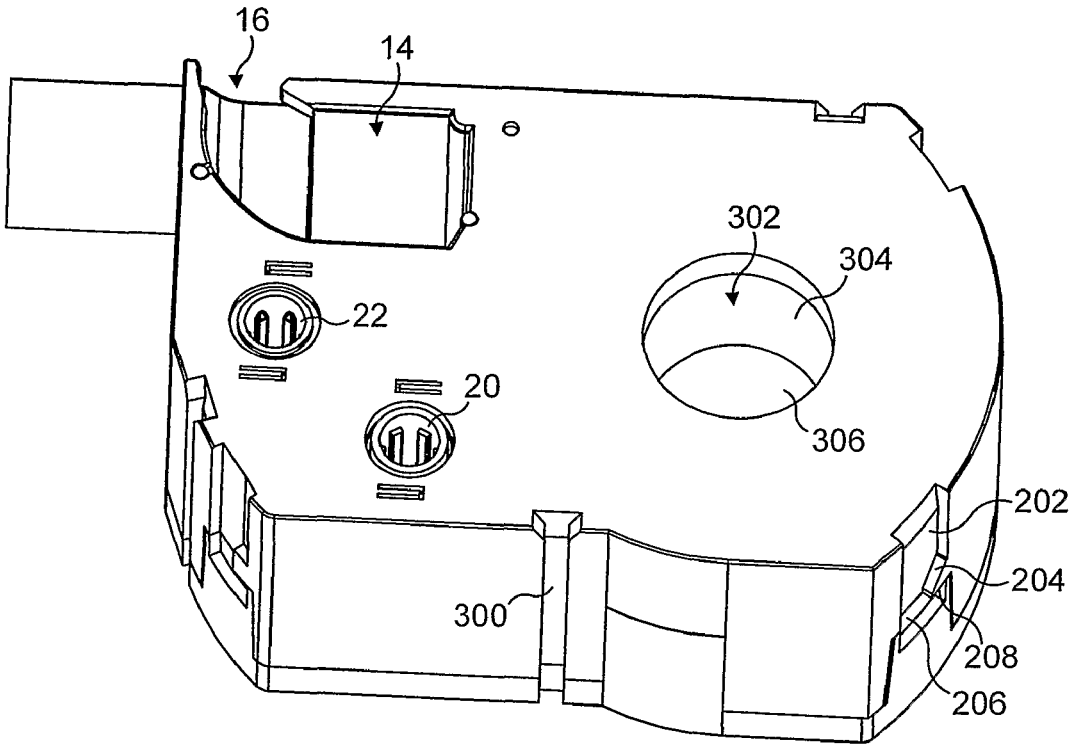
FIG. 23 shows another bottom perspective view of the cassette from a different angle to that shown in FIGS. 21 and 22.
Figure 24:
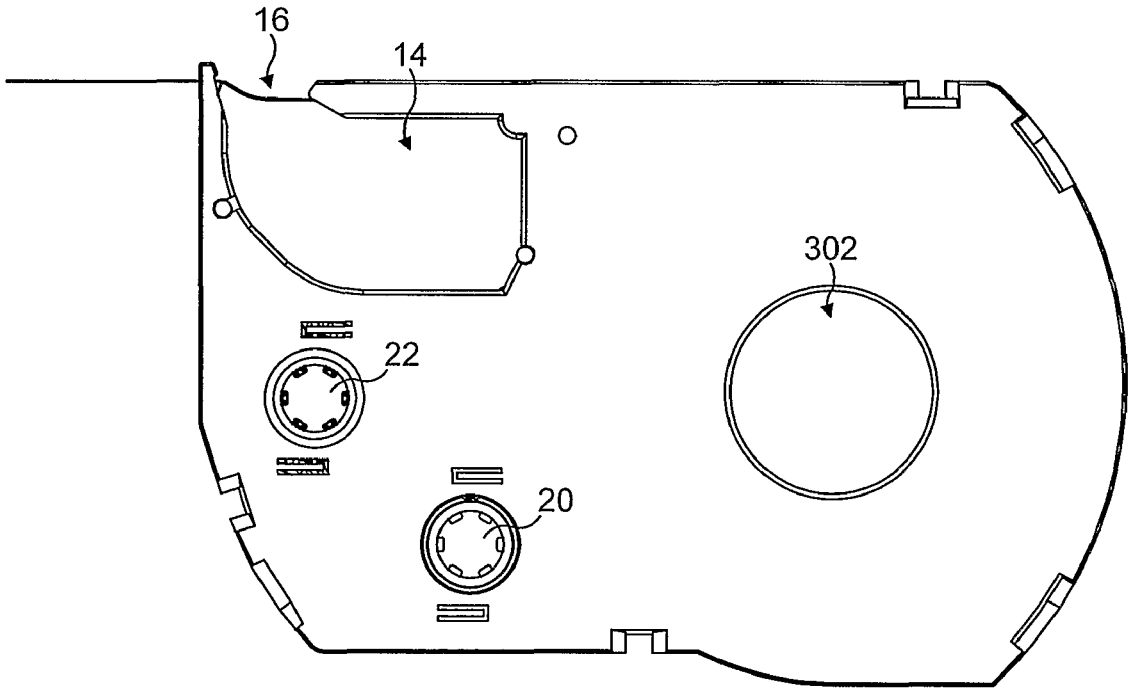
FIG. 24 shows a bottom view of the cassette.

FIGS. 23 and 24 show further views of the cassette illustrating the above-described features.

Figure 25:
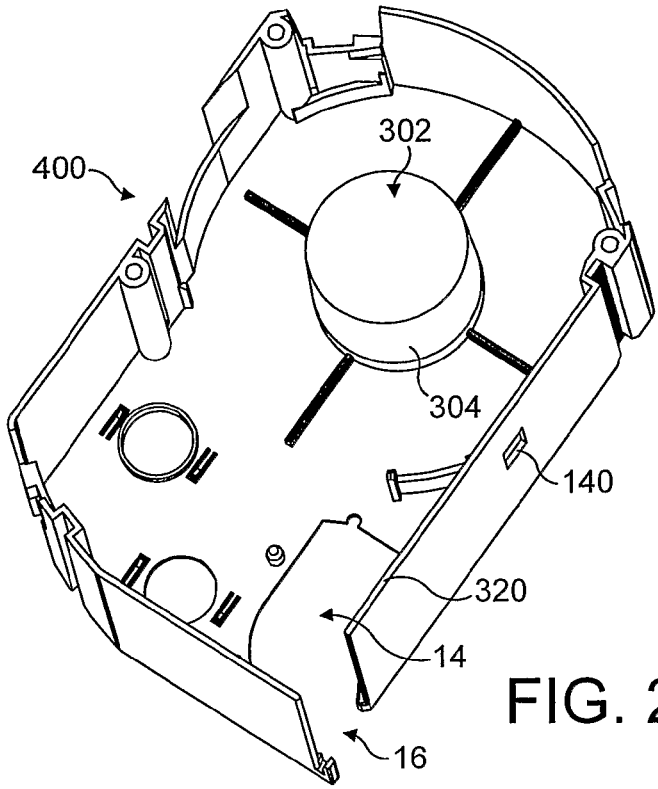
FIG. 25 shows a perspective view of a lower casing of the cassette showing the interior of the lower casing.
Figure 26:
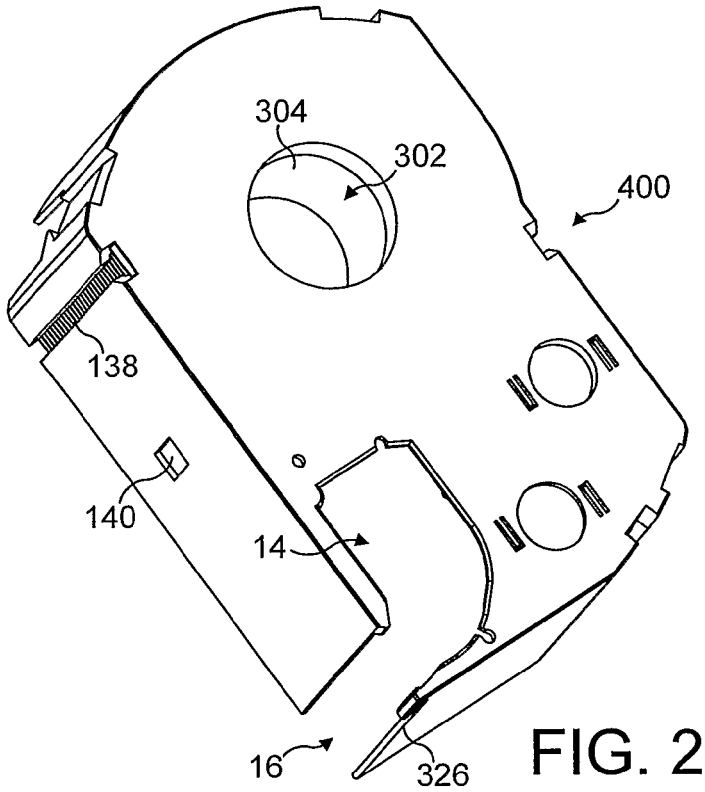
FIG. 26 shows a perspective view of the lower casing of the cassette showing the exterior of the lower casing.
Figure 27:
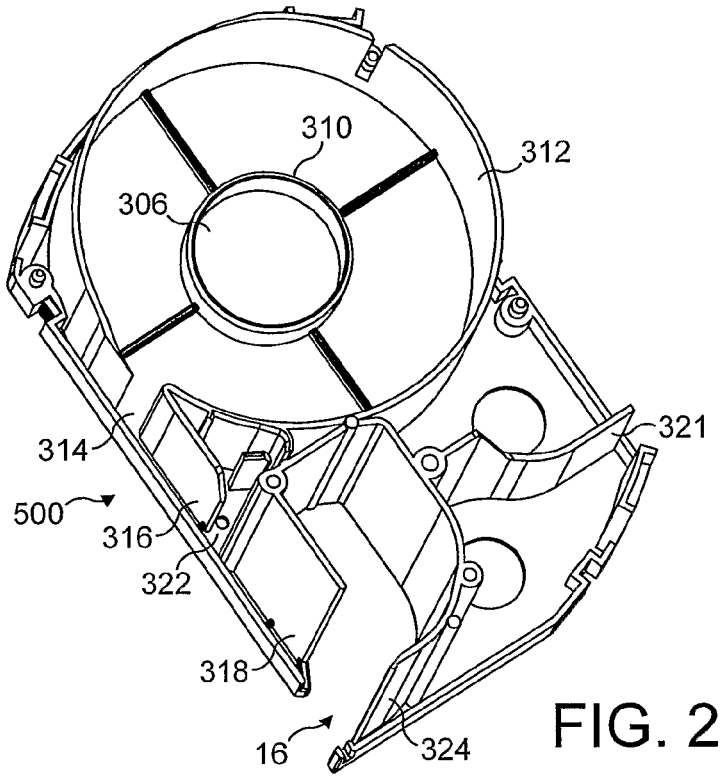
FIG. 27 shows a perspective view of an upper casing of the cassette showing the interior of the upper casing.
Figure 28:
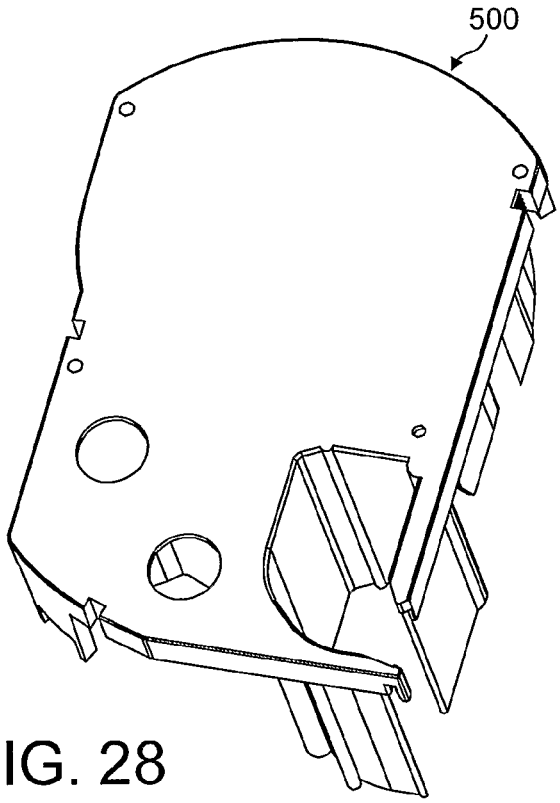
FIG. 28 shows a perspective view of the upper casing of the cassette showing the exterior of the upper casing.

FIG. 25 shows the interior of the lower casing and FIG. 26 shows the exterior of the lower casing. The lower casing comprises the opening 302 and sidewall 304 of the recess for receiving the ejector. The recess base 306 may be provided on an opposite side of the recess to the opening 306 in the lower casing. Alternatively, as shown in the illustrated embodiment, the sidewall of the recess cooperates with an inner surface of the upper casing which forms the recess base. FIG. 27 shows the interior of the upper casing with the recess base 306 while FIG. 28 shows the exterior of the upper casing. A cylindrical ring 310 is provided in the inner surface of the upper casing which cooperates with the side wall 304 to aid in aligning the upper and lower casings. The tape supply (not shown) is positioned around the recess between the recess sidewall 304 and outer tape supply housing wall 312. An opening 314 in wall 312 is provided for allowing tape to exit along a space provided between inner walls 316, 318 in the upper casing and outer wall 320 in the lower casing towards the opening 16 for printing.

The height of the upper surface of the ejector above the base and the depth of the ejector surface (recess base 360) in the recess of the cassette are selected whereby the ejector is substantially housed in the recess when the cassette is inserted in the printer with the upper surface of the ejector being biased against the ejector surface of the cassette. Accordingly, when the locking mechanism is released the cassette is moved in an upward direction thus ejecting the cassette.

The ink ribbon supply (not shown) is provided between the tape supply housing wall 312 and the segregating wall 321 which separates the ink ribbon supply from the ink ribbon take-up spool (not shown). The ink ribbon passes through opening 322 and passes in cooperation with the tape towards the opening 16 for printing before passing between inner wall 324 of the upper casing and outer wall 326 of the lower casing to the ink ribbon take-up spool.

The above-described cassette and locking mechanism is simple in construction and easy to manufacture. The mechanism is also compact for use in small hand held printers. Good alignment and locking of the cassette in the cassette receiving bay is achieved resulting in good print quality even when the printer is moved during printing. Furthermore, the damping mechanisms provided in the present arrangement result in controlled insertion and ejection of the cassette so as to prevent damage of the cassette or parts of the printer.

An important advantage for a locking mechanism with an ejecting arrangement is the fact that it is a lot more easy to insert and remove a cassette, certainly when the printer is designed for a wide range of widths for image receiving medium having different cassette sizes. That is, when a cassette receiving bay is designed for receiving a cassettes having a large width (e.g. for a cassette with tape of 36 mm), it is difficult to insert and remove manually a cassette with a small width (e.g. a cassette with tape of 6 mm). This problem is solved by the present locking and ejector mechanism.

According to another embodiment of the present invention, the locking mechanism may be linked to the printhead and/or platen for moving the printhead and/or platen into a printing position when a cassette is inserted into the cassette-receiving bay and for moving the printhead and/or platen into a non-printing position when the cassette is ejected.

While this invention has been particularly shown and described with reference to preferred embodiments, it will be understood to those skilled in the art that various changes in form and detail may be made without departing from the scope of the invention as defined by the appended claims.

The invention claimed is:

1. A label cassette comprising a housing, said housing having a base, a top, and sides extending from the base to the top, the housing containing a roll of print receiving medium having an axis of rotation extending in a first direction, said housing further having a gear rack disposed on one of said sides for co-operation with a damping mechanism extending from a sidewall of a cassette receiving bay of a label printer when the label cassette is inserted into and ejected from the label printer, wherein said gear rack extends in a direction substantially parallel to said first direction.

2. A label cassette according to claim 1, wherein said gear rack is disposed in an elongate recess for cooperating with an elongate guide member of a label printer to align the label cassette when it is inserted into and ejected from the label printer.

3. A label cassette according to claim 2, wherein said elongate recess has a wider portion at an end thereof having at least one sloped surface for guiding the elongate guide member of the label printer into the elongate recess when the label cassette is inserted into the label printer.

4. A combination of a label printer comprising a cassette receiving bay, a print head in said cassette receiving bay, said cassette receiving bay having a damping mechanism extending from a sidewall of the cassette receiving bay for interaction with a gear rack on a sidewall of a cassette, and a label cassette comprising a housing having a base, a top, and sides extending from the base to the top, the housing containing a roll of print receiving medium having an axis of rotation extending in a first direction, said housing further having a gear rack disposed on one of said sides and extending in a direction substantially parallel to said first direction for co-operation with the damping mechanism extending from sidewall of the cassette receiving bay of label printer when the label cassette is inserted into and ejected from the label printer.

* * * * *